US008978537B2

(12) United States Patent
Thuman

(10) Patent No.: US 8,978,537 B2
(45) Date of Patent: Mar. 17, 2015

(54) MINE PROTECTION ACCESSORY FOR WHEELED VEHICLES

(75) Inventor: Christer Thuman, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 13/989,258

(22) PCT Filed: Nov. 24, 2011

(86) PCT No.: PCT/SE2011/000214

§ 371 (c)(1),
(2), (4) Date: May 23, 2013

(87) PCT Pub. No.: WO2012/070996

PCT Pub. Date: May 31, 2012

(65) Prior Publication Data

US 2013/0239794 A1 Sep. 19, 2013

(30) Foreign Application Priority Data

Nov. 25, 2010 (SE) ..... 1001135

(51) Int. Cl.
*F41H 7/00* (2006.01)
*B60B 7/04* (2006.01)
*F41H 7/04* (2006.01)

(52) U.S. Cl.
CPC ... *F41H 7/00* (2013.01); *F41H 7/04* (2013.01)
USPC ..... 89/36.09; 301/37.105

(58) Field of Classification Search
CPC ..... B60B 7/00; B60B 7/01
USPC ..... 89/36.08, 36.09; 301/37.101, 37.22, 301/37.23, 37.105
See application file for complete search history.

(56) References Cited

U.S. PATENT DOCUMENTS

| | | | | |
|---|---|---|---|---|
| 1,375,051 | A * | 4/1921 | Lackner | 301/20 |
| 1,697,307 | A * | 1/1929 | Earnest | 301/123 |
| 6,254,194 | B1 * | 7/2001 | Capouellez et al. | 301/37.23 |

FOREIGN PATENT DOCUMENTS

| | | | |
|---|---|---|---|
| DE | 19631715 | A1 | 2/1998 |
| EP | 1275928 | A2 | 1/2003 |
| EP | 1574812 | A1 | 9/2005 |
| GB | 2052695 | A | 1/1981 |
| GB | 2419567 | A | 5/2006 |

OTHER PUBLICATIONS

International Preliminary Report on Patentability issued May 28, 2013 in counterpart Application No. PCT/SE2011/000214.

* cited by examiner

*Primary Examiner* — Reginald Tillman, Jr.
(74) *Attorney, Agent, or Firm* — Novak Druce Connolly Bove + Quigg LLP

(57) ABSTRACT

The present invention relates to a mine protection accessory for fitting to military or civil wheeled vehicles (2) as protection against landmines (12, 12', 12") or homemade bombs. The mine protection ( ) is characterized in that the mine protection accessory is configured for fitting to the underside of the vehicle (2) adjacent to one of the wheels (3) of the vehicle (2), and in that the mine protection accessory comprises at least one guard plate (1, 11) configured to deflect pressure, splinters and gravel from a landmine (12, 12', 12") away from the underside of the vehicle (2).

6 Claims, 2 Drawing Sheets

MINE PROTECTION ACCESSORY FOR WHEELED VEHICLES

CROSS REFERENCE TO RELATED APPLICATIONS

Figure 1:
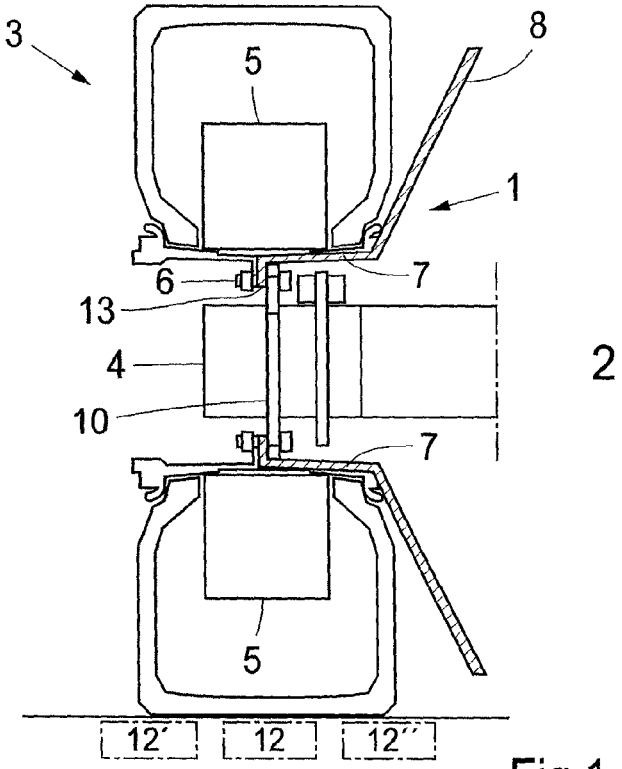

This application is a National Phase filing under 35 U.S.C. §371 of PCT/SE2011/000214 filed on Nov. 24, 2011; and this application claims priority to Application No. 1001135-1 filed in Sweden on Nov. 25, 2010, under 35 U.S.C. §119; the entire contents of all are hereby incorporated by reference.

TECHNICAL FIELD

The present invention relates to a mine protection accessory for fitting to military or civil wheeled vehicles as protection against landmines.

BACKGROUND AND PRIOR ART

Vehicles which are exposed to mine explosions from landmines imply high stresses upon the wheels and rims of the vehicle, which can lead to damage resulting in the vehicle becoming unusable. Even if the wheel is not torn off, there is a high risk of the wheel becoming unusable, since the rim is so strongly compressed that the rim locks the wheel against the axle casing. The cause is, above all, the concentrated force action from thrown-up sand and gravel directed towards the edge of the rim.

A number of different mine protection devices for vehicles are known from the literature. The majority of these are based on the use of guard plates, which are fixedly fitted to the body of the vehicle on the underside of the body. EP 1275928, FIG. 1, column 2, discloses a mine protection device comprising a concavely configured guard plate 1, which covers the underside of the body and is fitted to diagonal bars 4 arranged between the wheel pairs 21 of the vehicle and the body of the vehicle via the wheel axle 21 and bearing housing 5 of the vehicle.

The positioning and concave shape of the guard plate means that the impact from a mine, such as pressure, gravel and splinters, is deflected away from the underside of the body, so that harmful effects upon the vehicle body and upon the crew are prevented, while the impact is also deflected away from the wheel axle 2 and bearing housing 5 of the vehicle.

A problem with said mine protection device is its size and weight, and also that it needs to be adapted, during fitting, to the vehicle construction.

OBJECT OF THE INVENTION AND DISTINGUISHING FEATURES THEREOF

A main object of the present invention is a mine protection accessory for wheeled vehicles which is light and flexible and which can be fitted to and removed from a vehicle, as required, and which does not need to be adapted, during fitting, to the vehicle construction.

Said object, and other aims which are not enumerated here, are satisfactorily met by virtue of that which is stated in the present independent patent claim.

Embodiments of the invention are defined in the dependent patent claims.

Thus, according to the present invention, a mine protection accessory for wheeled vehicles which is light and flexible and which can easily be fitted to and removed from the vehicle, as required, and which does not need to be adapted, during fitting, to the body of the vehicle, has been provided.

The mine protection accessory is characterized in that it is configured for fitting to the wheel rim of the vehicle, and in that the mine protection accessory comprises at least one guard plate configured to deflect splinters and gravel which are generated upon detonation of a landmine, wherein said at least one guard plate comprises a fastening part in the form of a flange with hole perforations for fitting of the guard plate to the wheel rim of the vehicle with the same screws or bolts by which the wheel is fitted.

According to further aspects of the mine protection accessory:

the guard plate is disposed on the inner side of the wheel and comprises a cylindrical part which extends along the wheel axle from the fastening part of the guard plate to the inner side of the wheel, and a terminating conical part on the inner side of the wheel, the guard plate is disposed on the outer side of the wheel and comprises a cylindrical part which extends along the wheel axle from the fastening part of the guard plate to the outer side of the wheel, and a terminating angled part on the outer side of the wheel, the guard plate comprises a deformation-damping reinforcing part disposed on the conical part of the guard plate, the deformation-damping reinforcing part is fitted to the guard plate with a glue joint, the deformation-damping reinforcing part comprises a ductile steel material.

ADVANTAGES AND EFFECTS OF THE INVENTION

The invention brings a number of advantages and effects, some of the most important of which are as follows:

the mine protection accessory can be used on existing wheels without any extra assembly parts or without the body needing to be adapted, the mine protection accessory combats deformation of the wheel rim, the mine protection accessory protects the underside of the body from the impact of pressure, gravel and splinters when a mine explodes beneath the wheels of the vehicle, the mine protection accessory can be easily fitted to and removed from the wheel with the same screws or bolts which hold the wheel in place, the mine protection accessory is a simple and cheap construction.

The basic concept of the invention is thus a mine protection accessory which can be easily fitted to an existing vehicle without any adaptations of the vehicle construction needing to be made, i.e. without the need to find a workshop.

Examples of fields of application are military or humanitarian efforts in countries in which landmines or homemade bombs are commonly found and in which a wheeled vehicle needs to be refitted quickly with extra mine protection.

The invention has been defined in the following patent claims and shall now be described in somewhat greater detail in connection with the appended figures.

Figure 2:
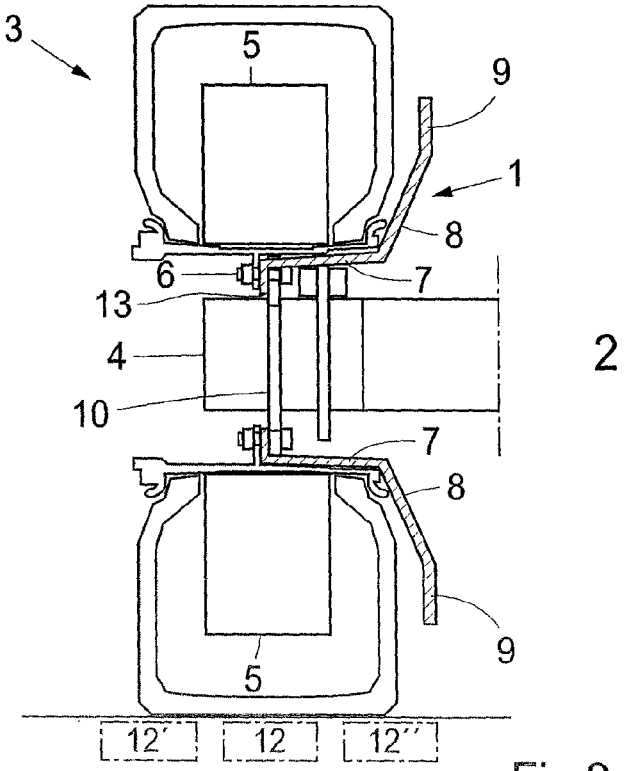
Figure 3:
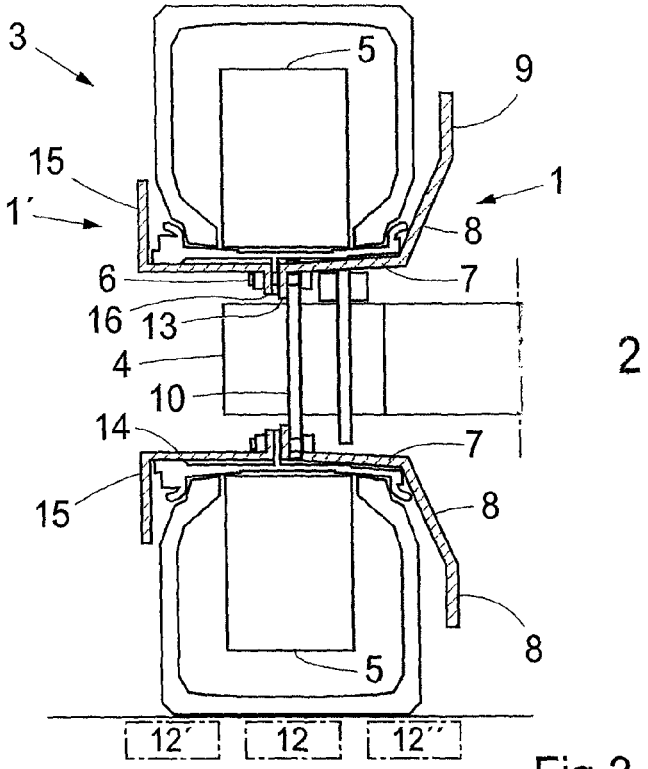
Figure 4:
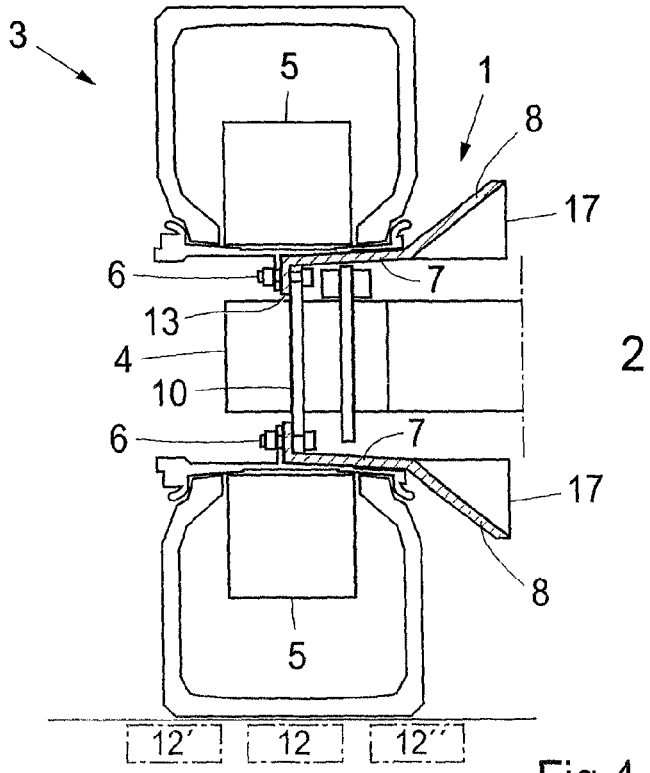

Further advantages and effects will emerge from a study and consideration of the following, detailed description of the invention, while at the same time referring to the appended drawing figures, in which:

FIG. 1 shows in schematic representation a mine protection accessory having an inner guard plate fitted to the wheel rim of a vehicle with the same screws or bolts by which the wheel of the vehicle is fitted, FIG. 2 shows in schematic representation an alternative configuration of the guard plate in FIG. 1, FIG. 3 shows in schematic representation a mine protection accessory having an inner and an outer guard plate fitted to each side of the wheel rim of the vehicle with the same screws or bolts by which the wheel of the vehicle is fitted, FIG. 4 shows in schematic representation an inner guard plate provided with a deformation-damping reinforcing part.

DETAILED DESCRIPTION OF EMBODIMENTS

FIGS. 1 and 2 show a preferred embodiment of a mine protection accessory arranged for fitting to the underside of a wheeled vehicle 2 adjacent to one of the wheels 3 of the vehicle. The mine protection accessory comprises an inner guard plate 1 for fitting to the inner side of the wheel 3 of the vehicle, to the rim 10 of the wheel, with the same screws 6 or bolts which hold the wheel 3 in place. The guard plate 1 is configured to deflect the impact of pressure, gravel and splinters from a detonating mine 12, 12', 12" away from the underside of the vehicle 2.

The guard plate 1 is configured, preferably, for fitting to the inner side of the wheel 3, FIGS. 1 and 2, which gives very good protection against mines 12, 12', 12" located in the ground beneath the wheels of the vehicle or beneath the ground by the sides of the wheel 3. The guard plate 11 can also be configured for fitting to the outer side of the wheel 3, which in combination with a guard plate 1 fitted to the inner side of the wheel, FIG. 3, gives an additionally reinforced mine protection.

The guard plate 1, FIG. 1, comprises a fastening part 13 configured as a flange with hole perforations for fitting of the guard plate 1 to the rim 10 of the wheel 3 with the same screws 6 or bolts and nuts by which the wheel 3 is fitted. The guard plate 1 further comprises a cylindrical part 7 and a conical part 8, wherein the cylindrical part 7 extends from the fastening part 13 of the guard plate parallelly along the wheel axle 4 to the inner side of the wheel. The cylindrical part 7 can also be slightly conical. The conical part 8 adjoining the cylindrical part 7 has the shape of a funnel and extends along the inner side of the wheel, up towards the body of the vehicle 3 and down towards the ground. The conical part 8 has an extent which, preferably, extends halfway along the inner side of the wheel 3 at an angle relative to the wheel axle 4 of between 30 and 60 degrees.

The conical part 8 can be convexly or concavely shaped. FIG. 2 shows a special embodiment of the guard plate 1, in which the conical part 8 is terminated with an angled part 9 which extends radially along the inner side of the wheel 3 level with the emergency running element 5 of the wheel. The emergency running element 5 is used if the tyre is punctured.

The configuration of the guard plate 1 according to FIG. 2 is advantageous in that the guard plate 1 does not cut down into the ground if the wheel 3 is punctured, but has a limited benefit should the mine 12" be found farther inside the inner side of the wheel 3. Further alternative configurations of the guard plate 1 are possible, depending on which parts of the underside of the vehicle 2 are to be protected and depending on the type of vehicle 2.

In FIG. 4 is shown an alternative embodiment, wherein the conical part 8 of the guard plate 1 is provided with a deformation-damping reinforcing part 17, whose function is to further combat the deformation of the rim 10 and prevent the wheel 3 from being torn off from the rim 10.

The reinforcing part 17 comprises, preferably, some type of ductile material, for example soft steel. Other materials too are possible, for example fiber-reinforced plastics materials. The reinforcing part 17 is fitted, preferably, to the guard plate 1 with a glue joint, alternatively with a screw or weld joint.

The invention is not limited to shown embodiments, but can be varied in different ways within the scope of the patent claims. It will be recognized, for example, that the number, size, material and shape of those elements and parts which form part of the mine protection device and are of importance for the invention, for example components and fastening devices necessary for the fitting of the wheels and the guard plates, can be adapted with regard to one another and with regard to the vehicle and to the type of mines against which the mine protection accessory aims to protect.

The invention claimed is:

1. Mine protection accessory for fitting to military or civil wheeled vehicles as protection for wheels and rims against landmines or homemade explosive charges, wherein the mine protection accessory is configured for fitting to the underside of the vehicle, and in that the mine protection accessory comprises at least one guard plate configured to deflect splinters and gravel which are generated upon detonation of a landmine away from the underside of the vehicle, wherein said at least one guard plate comprises a fastening part in the form of a flange with hole perforations for fitting of the guard plate to the wheel rim of the vehicle with the same screws or bolts by which the wheel is fitted to the vehicle, wherein the at least one guard plate is configured to be disposed on the inner side of the wheel and comprises a cylindrical part which is configured to extend along the wheel axle from the fastening part of the guard plate to the inner side of the wheel, and a terminating conical part on the inner side of the wheel, and wherein the conical part is terminated with an angled part, which extends radially along the inner side of the wheel level with an emergency running element of the wheel.

2. Mine protection accessory according to claim 1, which further comprises an outer guard plate that is disposable on the outer side of the wheel and which comprises a cylindrical part which extends along the wheel axle from a fastening part of the outer guard plate to the outer side of the wheel, and a terminating angled part on the outer side of the wheel.

3. Mine protection accessory according to claim 1, wherein the guard plate comprises a deformation-damping reinforcing part disposed on the conical part of the guard plate.

4. Mine protection accessory according to claim 3, wherein the deformation-damping reinforcing part is fitted to the guard plate with a glue joint.

5. Mine protection accessory according to claim 3, wherein the deformation-damping reinforcing part comprises a ductile steel material.

6. Mine protection accessory according to claim 4, wherein the deformation-damping reinforcing part comprises a ductile steel material.

* * * * *